US007654262B1

(12) United States Patent
Warkander

(10) Patent No.: US 7,654,262 B1
(45) Date of Patent: Feb. 2, 2010

(54) SYSTEM FOR REDUCING HYDROSTATIC LOAD IMBALANCES IN A DRIVER'S OPEN-CIRCUIT BREATHING APPARATUS

(75) Inventor: Dan E. Warkander, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 664 days.

(21) Appl. No.: 11/605,063

(22) Filed: Nov. 29, 2006

(51) Int. Cl.
*A62B 7/04* (2006.01)
*A62B 9/02* (2006.01)

(52) U.S. Cl. ..... 128/204.26; 128/205.24

(58) Field of Classification Search ..... 128/204.26, 128/202.14, 205.24, 205.25; 137/45, 38, 137/907, 908

See application file for complete search history.

(56) References Cited

U.S. PATENT DOCUMENTS 3,841,348 A * 10/1974 O'Neill ..... 137/494
3,877,425 A * 4/1975 O'Neill ..... 128/202.19
4,971,108 A * 11/1990 Gottlieb ..... 137/495
7,504,599 B1 * 3/2009 Chesters ..... 200/61.45 R

* cited by examiner

*Primary Examiner*—Steven O Douglas
*Assistant Examiner*—Christopher Blizzard
(74) *Attorney, Agent, or Firm*—James T. Shepherd

(57) ABSTRACT

The system of the present invention reduces hydrostatic imbalances acting on the diaphragm of a diver's open-circuit breathing apparatus' regulator. In general, the system applies a flexing force to the diaphragm based on the position of the diver's head relative to gravity when the mouthpiece is in the diver's mouth. The system can be realized by a simple mechanical pendulum assembly attached to the regulator.

12 Claims, 2 Drawing Sheets

SYSTEM FOR REDUCING HYDROSTATIC LOAD IMBALANCES IN A DRIVER'S OPEN-CIRCUIT BREATHING APPARATUS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to open-circuit breathing apparatus, and more particularly to a system coupled to a diver's regulator of an open-circuit breathing apparatus for reducing hydrostatic load imbalances on the regulator.

BACKGROUND OF THE INVENTION

In a diver's open-circuit breathing apparatus, a regulator is used to provide breathing gas during a diver's inhalations. Typically, the regulator incorporates a mouthpiece coupled to a valve that opens (to provide breathing gas to the mouthpiece) under the control of a flexible membrane or diaphragm mounted in an exterior wall of the regulator. More specifically and as is well known in the art, the diaphragm/valve assembly is constructed such that a pressure balance is achieved across the assembly when a diver is under water. As a result of the pressure balance, the diaphragm flexes to cause the valve to open as the diver inhales.

This type of regulator works well when the diver's mouth and lungs are at the same height, i.e., when the diver is swimming horizontally or substantially perpendicular to the force of gravity. However, when a diver stands or swims with his head up, the lungs are deeper than the mouth and the water depth of the lungs is greater than the depth of the mouth. This generates a pressure difference between the outside of the chest and the gas inside the lungs that makes it harder for a diver to breathe than when there is no pressure difference. This situation is known as "static lung load", "hydrostatic imbalance", or "positive/negative pressure breathing". For the diver who is standing/swimming "head up", a mouth-held regulator imposes a negative hydrostatic imbalance. Conversely, if the diver is "head down", a positive hydrostatic imbalance exists. It is well known that excessive imbalances will limit the diver's exercise capability and endurance.

SUMMARY OF THE INVENTION

Accordingly, it is an object of the present invention to provide a system for reducing hydrostatic imbalances acting on a diver's open-circuit breathing apparatus.

Another object of the present invention is to provide a system that can be used to modify a diver's regulator in a way that reduces hydrostatic imbalances acting on the regulator's diaphragm.

Other objects and advantages of the present invention will become more obvious hereinafter in the specification and drawings.

In accordance with the present invention, a diver's open-circuit breathing apparatus is modified. The modified portion of the breathing apparatus is a regulator that provides breathing gas during inhalation through a mouthpiece. The regulator has a flexible diaphragm mounted in an exterior wall thereof that undergoes flexing during inhalation to control a valve system in the regulator to thereby control delivery of the breathing gas to the mouthpiece. The system of the present invention reduces hydrostatic imbalances acting on the diaphragm. In general, the system is coupled to the diaphragm to apply a flexing force to the diaphragm based on the position of the diver's head relative to gravity when the mouthpiece is in the diver's mouth. The system can be realized by a simple mechanical pendulum assembly attached to the regulator.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
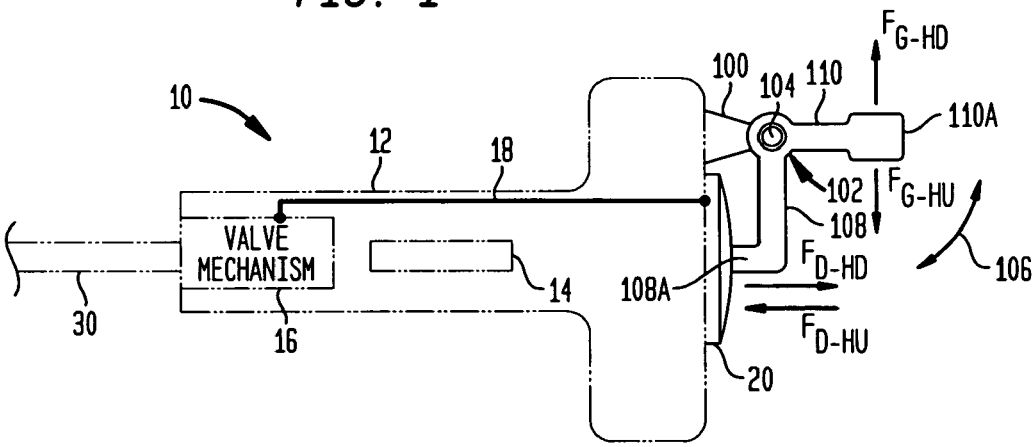
FIG. 1 is a side view of a conventional regulator of a diver's open-circuit breathing apparatus equipped with a system for reducing hydrostatic imbalances acting on the regulator in accordance with the present invention.

Referring now to the drawings and more particularly to FIG. 1, a conventional regulator of a diver's open-circuit breathing apparatus is shown in phantom lines and is referenced generally by numeral 10. As is known in the art, regulator 10 has a body 12 that incorporates a mouthpiece 14 that is inserted into a diver's mouth. A line 30 delivers breathing gas to regulator 10. Within body 12 is a valve mechanism 16 that opens during diver inhalation to permit breathing gas in line 30 to be delivered to mouthpiece 14.

In general, valve mechanism 16 has a mechanical linkage 18 coupling valve mechanism 16 to a flexible diaphragm 20 mounted in an exterior wall of body 12. Valve mechanism 16 opens/closes based upon the movement of flexible diaphragm 20. Assuming pressure is balanced on either side of diaphragm 20, inhalation through mouthpiece 14 causes a negative pressure to develop within body 12 that acts on diaphragm 20. As diaphragm 20 flexes into body 12, linkage 18 causes valve mechanism 16 to open so that breathing gas in line 30 can enter body 12 and flow to mouthpiece 14. As is well known in the art, the above-described basic elements/functions of regulator 10 can be achieved with a variety of particular constructions. It is to be understood that the present invention is not limited by the particular design of regulator 10.

The present invention is a simple mechanical system that cooperates with regulator 10 to automatically reduce hydrostatic imbalances acting on regulator 10. As described previously herein, the hydrostatic imbalances occur when a diver's mouth is located above or below his lungs relative to earth's gravitational force. In general, the present invention operates on diaphragm 20 to (i) flex diaphragm 20 inward to increase the opening force acting on valve mechanism 16 when a diver's mouth is above his lungs, (ii) flex diaphragm 20 outward to decrease the opening force acting on valve mechanism 16 when a diver's mouth is below his lungs, or (iii) act on diaphragm 20 in a neutral way whereby no flexing force is applied to diaphragm 20 when a diver is in a horizontally-prone swimming position where the diver's mouth is approximately even with his lungs relative to earth's gravitational force.

An embodiment of the present invention illustrated in FIG. 1 includes a rigid mount 100 fixedly coupled to body 12.

Typically, mount 100 is positioned adjacent to diaphragm 20. A pendulum 102 is hingedly coupled to mount 100 at a hinge 104 that permits pendulum 102 to freely pivot thereabout in a rotational plane indicated by two-headed arrow 106. Pendulum 102 has two arms 108 and 110 disposed in rotational plane 106. Arm 108 is evenly weighted along its length with its outboard end 108A being fixedly coupled to an exterior surface of diaphragm 20. Outboard end 110A of arm 110 is weighted relative to the rest of arm 110 as indicated by the enlarged area of outboard end 110A. Accordingly, the force of gravity will always act on outboard end 110A with the resulting movement/non-movement of pendulum 102 in rotational plane 106 being independent on the position of pendulum 102 relative to the force of gravity.

Figure 2:
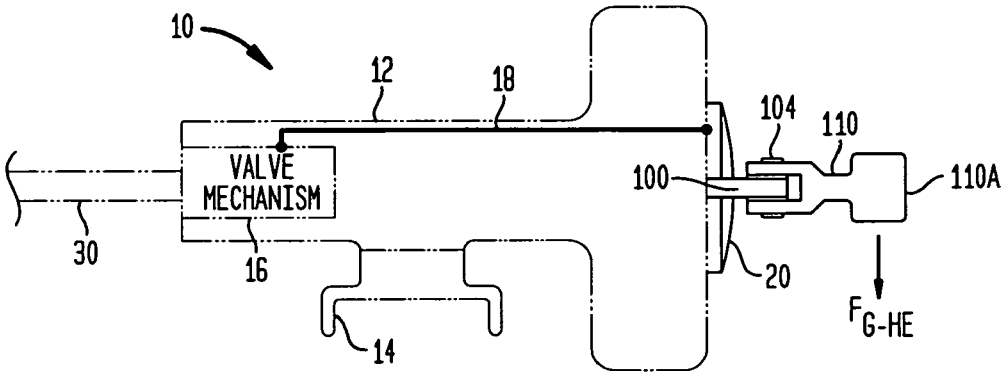
FIG. 2 is a top view taken along line 2-2 in FIG. 1 to illustrate the force of gravity as it acts on the system when the diver is swimming horizontally or perpendicular with respect to the force of gravity.

With the aid of FIGS. 1 and 2, three positions of regulator 10 with the resulting gravitational force acting on pendulum 102 will be described. The three positions are a diver swimming "head up" (i.e., mouth above lungs), "head down" (i.e., mouth below the lungs), and "head even" (i.e., mouth approximately level with the lungs). In each position, a diver (not shown) is assumed to have mouthpiece 14 in his mouth. In the "head up" position, the force of gravity acting on outboard end 110A is denoted as $F_{G\text{-}Hu}$. A resulting force $F_{D\text{-}Hu}$ is applied to diaphragm 20 (via outboard end 108A). The force $F_{D\text{-}Hu}$ causes diaphragm 20 to flex inward so that the valve opening force applied to valve mechanism 16 increases thereby providing more breathing gas to mouthpiece 14 as the diver swims "head up". In the "head down" position, the force of gravity acting on outboard end 110A is denoted as $F_{G\text{-}HD}$. That is, regulator 10 is essentially turned upside down as a diver swims down head-first through the water so that force $F_{D\text{-}HD}$ is applied to diaphragm 20 via outboard end 108A. The force $F_{D\text{-}HD}$ causes diaphragm 20 to flex outward so that the valve opening force applied to valve mechanism 16 decreases as the diver swims "head down".

When the diver is swimming "head even", the diver is typically facing down so that the force of gravity (denoted as $F_{G\text{-}HE}$) acting on pendulum 102 is applied perpendicularly to rotational plane 106. As a result of $F_{G\text{-}HE}$ being applied perpendicular to rotational plane 106, no flexing force is applied to diaphragm 20 by outboard end 108A. Therefore, when a diver is swimming "head even", the present invention does not increase or decrease the opening force acting on valve mechanism 16.

While the present invention has been described relative to three specific positions, it is obvious that a diver can assume positions that are between these conditions. In such cases, the forces applied to diaphragm 20 will be based on the vertical component (i.e., the $F_{G\text{-}Hu}$ or $F_{G\text{-}HD}$ component) of a composite force acting on outboard end 110A.

The advantages of the present invention are numerous. The simple mechanical pendulum assembly will reduce hydrostatic imbalances affecting a diver's ability to breathe efficiently in different swimming positions. The present invention can be adapted for use with a variety of existing regulator designs.

Figure 3:
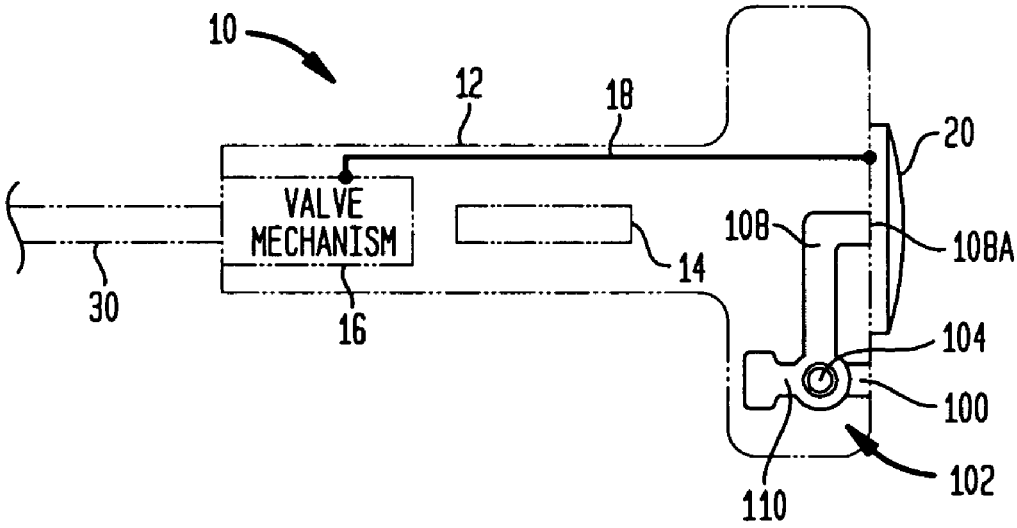
FIG. 3 is a side view of a conventional regulator of a diver's open-circuit breathing apparatus equipped with a system for reducing hydrostatic imbalances acting on the regulator in accordance with another embodiment of the present invention.

Although the invention has been described relative to a specific embodiment thereof, there are numerous variations and modifications that will be readily apparent to those skilled in the art in light of the above teachings. For example, as illustrated in FIG. 3, mount 100 and pendulum 102 could be installed within regulator 10 with outboard end 108A being coupled to an interior surface of diaphragm 20. An advantage of this embodiment is that the pendulum assembly is protected within body 12. It is therefore to be understood that, within the scope of the appended claims, the invention may be practiced other than as specifically described.

What is claimed as new and desired to be secured by Letters Patent of the United States is:

1. In a diver's open-circuit breathing apparatus that includes a regulator for providing breathing gas during inhalation through a mouthpiece wherein the regulator has a flexible diaphragm mounted in an exterior wall thereof that undergoes flexing during inhalation to control a valve system in the regulator to thereby control delivery of the breathing gas to the mouthpiece, a system for reducing hydrostatic imbalances acting on the diaphragm, said system comprising means coupled to the diaphragm for applying a flexing force to the diaphragm based on the position of the diver's head relative to gravity when the mouthpiece is in the diver's mouth.

2. A system as in claim 1 wherein said means is adapted to be mounted on the exterior of the regulator.

3. A system as in claim 1 wherein said means is adapted to be mounted on the interior of the regulator.

4. A system as in claim 1 wherein said means comprises a pendulum assembly.

5. In a diver's open-circuit breathing apparatus that includes a regulator for providing breathing gas during inhalation through a mouthpiece wherein the regulator has a flexible diaphragm mounted in an exterior wall thereof that undergoes flexing during inhalation to control a valve system in the regulator to thereby control delivery of the breathing gas to the mouthpiece, a system for reducing hydrostatic imbalances acting on the diaphragm, said system comprising mechanical means coupled to the diaphragm for applying a flexing force to a surface of the diaphragm based on the position of the diver's head relative to gravity when the mouthpiece is in the diver's mouth.

6. A system as in claim 5 wherein said mechanical means is adapted to be mounted on the exterior of the regulator.

7. A system as in claim 5 wherein said mechanical means is adapted to be mounted on the interior of the regulator.

8. A system as in claim 5 wherein said mechanical means comprises a pendulum assembly.

9. In a diver's open-circuit breathing apparatus that includes a regulator for providing breathing gas during inhalation through a mouthpiece integral therewith, wherein the regulator has a flexible diaphragm mounted in an exterior wall thereof, and wherein the flexible diaphragm undergoes flexing during inhalation to control a valve system in the regulator to thereby control delivery of the breathing gas to the mouthpiece, a system for reducing hydrostatic imbalances acting on the diaphragm, said system comprising:

a mount adapted to be fixedly coupled to a portion of the regulator adjacent the diaphragm; and a pendulum hingedly coupled to said mount for applying a flexing force to the diaphragm based on the position of the diver's head relative to gravity when the mouthpiece is in the diver's mouth.

10. A system as in claim 9 wherein said mount and said pendulum are adapted to be coupled to the exterior of the regulator.

11. A system as in claim 9 wherein said mount and said pendulum are adapted to be coupled to the interior of the regulator.

12. A system as in claim 9 wherein said pendulum has a weighted end and a non-weighted end with said non-weighted end adapted to be fixedly coupled to the diaphragm and said weighted end being unencumbered.

* * * * *

UNITED STATES PATENT AND TRADEMARK OFFICE

CERTIFICATE OF CORRECTION

PATENT NO. : 7,654,262 B1
APPLICATION NO. : 11/605063
DATED : February 2, 2010
INVENTOR(S) : Dan E. Warkander It is certified that error appears in the above-identified patent and that said Letters Patent is hereby corrected as shown below:

On the title page, Item (54) and on lines 1-3 of Column 1 should read "System for Reducing Hydrostatic Load Imbalances in a Diver's Open-Circuit Breathing Apparatus"

Signed and Sealed this
Fifteenth Day of November, 2011

David J. Kappos

David J. Kappos
*Director of the United States Patent and Trademark Office*